US006797202B2

(12) United States Patent
Endo et al.

(10) Patent No.: US 6,797,202 B2
(45) Date of Patent: Sep. 28, 2004

(54) PARTICLES FOR ELECTRO-RHEOLOGICAL FLUID

(75) Inventors: Shigeki Endo, Kodaira (JP); Howard See, Kodaira (JP); Tasuku Saito, Kodaira (JP); Koji Sakata, Chuo-ku (JP); Kenji Fukuda, Kitakyushu (JP); Youichiro Hara, Kitakyushu (JP); Tatsuo Umeno, Kitakyushu (JP)

(73) Assignees: Bridgestone Corporaton, Tokyo (JP); Mitsui Mining Company, Limited, Tokyo (JP)

( * ) Notice: Subject to any disclaimer, the term of this patent is extended or adjusted under 35 U.S.C. 154(b) by 274 days.

(21) Appl. No.: 10/087,914

(22) Filed: Mar. 5, 2002

(65) Prior Publication Data

US 2002/0130429 A1 Sep. 19, 2002

Related U.S. Application Data

(62) Division of application No. 08/921,537, filed on Sep. 2, 1997, now abandoned.

(30) Foreign Application Priority Data

Sep. 6, 1996 (JP) ..... 8-236805

(51) Int. Cl.[7] ..... C01B 31/02

(52) U.S. Cl. ..... 264/5; 264/13; 264/29.1; 423/445 R

(58) Field of Search ..... 264/5, 11, 12, 264/13, 14, 29.1, 29.6, 29.7; 423/455 R, 448

(56) References Cited

U.S. PATENT DOCUMENTS

| | | | | |
|---|---|---|---|---|
| 4,489,132 | A | * 12/1984 | Shimoyama | 428/408 |
| 4,551,389 | A | 11/1985 | Ohtake et al. | |
| 4,638,057 | A | 1/1987 | Takahashi et al. | |
| 5,032,307 | A | 7/1991 | Carlson | |
| 5,106,521 | A | 4/1992 | Kurachi et al. | |
| 5,213,713 | A | 5/1993 | Reitz | |
| 5,217,701 | A | * 6/1993 | Sakata et al. | 423/447.1 |
| 5,252,250 | A | 10/1993 | Endo et al. | |
| 5,290,821 | A | 3/1994 | Sakurai et al. | |
| 5,326,489 | A | 7/1994 | Asako et al. | |
| 5,332,517 | A | 7/1994 | Torii et al. | |
| 5,352,718 | A | 10/1994 | Ishino et al. | |
| 5,445,759 | A | 8/1995 | Powell | |
| 5,501,809 | A | 3/1996 | Schober et al. | |
| 5,503,763 | A | 4/1996 | Podszun et al. | |
| 5,518,657 | A | 5/1996 | Fringeli et al. | |
| 5,536,426 | A | 7/1996 | Sasaki et al. | |
| 5,693,367 | A | 12/1997 | Sakurai et al. | |
| 5,705,088 | A | 1/1998 | Sasaki et al. | |
| 5,736,030 | A | 4/1998 | Tsuchitani et al. | |
| 5,779,880 | A | 7/1998 | Maruyama et al. | |
| 5,904,977 | A | 5/1999 | Reitz | |
| 5,910,269 | A | 6/1999 | Ono et al. | |

FOREIGN PATENT DOCUMENTS

| | | |
|---|---|---|
| CN | 1100750 | 3/1995 |
| JP | 53-93186 | 8/1978 |
| JP | B2-60-31211 | 7/1985 |
| JP | A-61-216202 | 9/1986 |
| JP | A-62-95397 | 5/1987 |
| JP | A-63-97694 | 4/1988 |
| JP | A-1-164823 | 6/1989 |
| JP | 06263417 | 9/1994 |
| JP | A-7-90287 | 4/1995 |
| JP | 07090287 | 4/1995 |
| JP | 08245971 | 9/1996 |

OTHER PUBLICATIONS

W. M. Winslow, "Induced Fibration of Suspensions", *Journal of Applied Physics*, vol. 20, pp. 1137–1140, Dec. 1949.

* cited by examiner

*Primary Examiner*—Mary Lynn Theisen
(74) *Attorney, Agent, or Firm*—Oliff & Berridge, PLC

(57) ABSTRACT

The present invention can provide particles for electro-rheological fluid for providing a high electro-rheological effect over a wide temperature range at low electric power consumption, and having high strength and excellent durability, not being susceptible to break-up due to the load of stress. Particles for an electro-rheological fluid of the present invention comprise spherical carbonaceous particles, obtained substantially from a solvent and a condensation product of a methylene type bond of aromatic sulfonic acid or a salt thereof.

4 Claims, 1 Drawing Sheet

PARTICLES FOR ELECTRO-RHEOLOGICAL FLUID

This application is a DIV of Ser. No. 08/921537 filed Sep. 2, 1997, now abandoned.

BACKGROUND OF THE INVENTION

1. Field of the Invention

The present invention relates to particles for an electro-rheological fluid, more specifically, particles for an electro-rheological fluid, comprising spherical carbonaceous particles of high strength.

2. Description of the Related Art

Electro-rheological fluids significantly and reversibly change their rheological characteristics under electrical control. The winslow effect, which is the phenomenon of dramatic change of the apparent viscosity of a fluid through the application of an electric field, has been known for a long time. The application of this effect for electrically controlling devices or parts, such as clutches, valves, engine mounts, actuators, and robot arms has been discussed. However, electro-rheological fluids in the early days were ones comprising particles such as starch dispersed in mineral oil or a lubricant, with the drawback of poor reproductivity. The electro-rheological effect, however, can be provided.

Many proposal have been made mainly on particles used as a dispersoid aiming at obtaining a fluid having a high electro-rheological effect and excellent reproductivity. For example, Japanese Patent Application Laid-Open (JP-A) No. 53-93186 discloses a highly water-absorbent resin having an acidic group such as polyacrylic acid. Japanese Patent Application Publication (JP-B) No. 60-31211 discloses an ion exchange resin, and JP-A No. 62-95397 discloses alumina silicate. These are hydrophilic solid particles. They are soaked in water and dispersed in an insulating oil-like medium. It is said that polarization generates in the particles comprising the particles through the action of water upon applying a high voltage from the outside, and subsequently the viscosity increases owing to the crosslinking among the particles in the electric field direction by the polarization.

However, the above-mentioned hydrous type electro-rheological fluids using hydrous particles have many problems such as incapability of having a sufficient electro-rheological effect over a wide temperature range, limitations of temperature in usage to avoid evaporation or freezing, increase in electric current consumption with temperature rises, instability caused by water transfer, and corrosion of electrode metals at the time of high voltage application, and thus it has been difficult to make practical use of them.

In order to solve these problems, anhydrous electro-rheological fluids including water-free particles have been proposed. For example, JP-A No. 61-216202 discloses organic semiconductor particles such as polyacene quinone, JP-A Nos. 63-97694 and 1-164823 disclose thin film-coated type composite particles including essentially dielectric particles prepared by forming a conductive thin film on the surface of organic or inorganic solid particles, and further forming an insulating thin film thereon, that is, a thin film having conductive/insulating electric characteristics. Furthermore, as for dispersoid particles, surface-treated metal particles and metal-covered inorganic particles are known. However, an anhydrous electro-rheological fluid has not been provided for a practical use due to various problems such as lack of electro-rheological effect with low electric power consumption, difficulty in industrial production, and availability only in an alternating current electric field.

In order to further improve electro-rheological effects in anhydrous electro-rheological fluids with low electric power consumption, it is necessary to increase the filling ratio of the dispersoid powders. However, this causes the initial viscosity of the fluid to increase and consequently the electro-rheological effect at the time of electric current application is reduced.

As a method of solving the problem JP-A No. 7-90287 discloses an electro-rheological fluid using spherical carbonaceous particles. It is advantageous to use homogeneous spherical carbonaceous particles as particles of the electro-rheological fluid, however, when the electro-rheological fluid is applied to an engine mount, an actuator, or a clutch, the particles are destroyed by the strain of vibration or shearing causing an increase in the viscosity when no electric field is applied. This and insufficient durability due to particle strength are problems.

SUMMARY OF THE INVENTION

The present invention involves improvement of the durability of the particles for electro-rheological fluid as well as further improvement of the electro-rheological effect.

An object of the present invention is to provide particles for electro-rheological fluid providing a high electro-rheological effect over a wide temperature range with low electric power consumption, and having high strength and excellent durability, and not being susceptible to break-up under stress.

The particles for electro-rheological fluid of the present invention are spherical carbonaceous particles, substantially obtained from a solvent and a condensation product of a methylene type bond of aromatic sulfonic acid or a salt thereof.

In particles for an electro-rheological fluid of the present invention, the above-mentioned spherical shape has a deviation of the minimum diameter of the carbonaceous particles within 30% of the average diameter.

Furthermore, it is preferable that particles of electro-rheological fluid, including spherical carbonaceous particles, of the present invention have physical properties such as a collapsing strength of 5 kgf/mm$^2$ or more, a maximum displacement amount of 3% or more, an ash content of 0.1% or less, and an average particle size of 0.1 to 20 $\mu$m.

Although it is preferable to have low initial viscosity to enhance electro-rheological effects in an electro-rheological fluid, in conventional particles for electro-rheological fluid, with a high filling ratio of particles, the initial viscosity increases accordingly, and consequently it is difficult to obtain high electro-rheological effects. However, since electro-rheological fluid utilizing spherical carbonaceous particles obtained from specific materials of the present invention have spherical particles, do not cause a drastic rise in viscosity despite an increased filling ratio, and have high strength without much risk of break-up under stress, excellent durability and effective electro-rheological effects can be obtained. Unlike amorphous fine particles, increases in electric current consumption due to local voltage rises derived from unevenness of the particle density are believed not to occur.

Particles of the electro-rheological fluid of the present invention when acting as an electro-rheological fluid have low initial viscosity and high electro-rheological effects at low power consumption over a wide temperature range. Furthermore, even when in use at a high shear rate in a device over a long period of time, since the particles have a large resistance to the shearing force and high strength to break-up, an excellent durability is shown without break-up of the particles or any increase in fluid viscosity when no electric field is applied.

DESCRIPTION OF THE PREFERRED EMBODIMENTS

Figure 1:
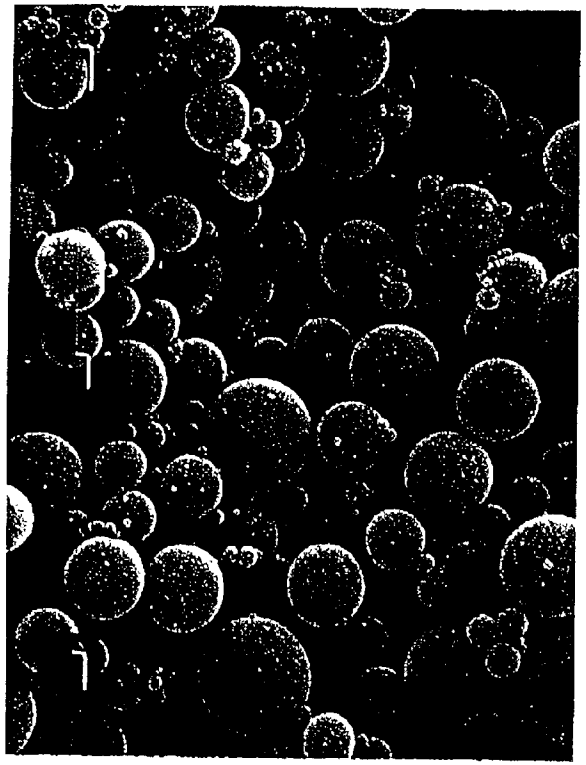
FIG. 1 is an electron microscopic photograph of the structure of spherical particles for electro-rheological fluid of Example 5 at a magnification of 5000×.

Hereinafter the present invention will be explained in detail with reference to concrete examples.

Particles for an electro-rheological fluid of the present invention are spherical carbonaceous particles, obtained substantially from a solvent and the condensation product of a methylene type bond of aromatic sulfonic acid or a salt thereof. Preferable substituents of the carbonaceous particles will be described below.

Examples of aromatic sulfonic acid or the salt thereof used in the present invention include naphthalene sulfonic acid, methyl naphthalene sulfonic acid, anthracene sulfonic acid, phenenthrene sulfonic acid, a sulfonated product of a mixture of polycyclic aromatic compounds, such as creosote oil, anthracene oil, tar and pitch, or a salt thereof. These sulfonic acids can be obtained easily by the sulfonation of their corresponding aromatic compounds by known methods. As an example of a cation forming an aromatic sulfonate, $NH_4^+$ can be presented. A little amount of an alkaline metal such as $Na^+$ or an alkaline earth metal ion such as $Ca^{2+}$ can be admixed as well.

Aromatic sulfones or condensation products of the salts used in the present invention can be easily produced in a known method. That is, in general, aromatic sulfonates or salts thereof are condensed using formalin, paraformaldehyde, hexamethylene tetramine or other aldehydes. They can also be obtained by the polymerization of aromatic sulfonate having a vinyl group such as polystyrene sulfonic acid. A polymer of aromatic sulfonic acids having a methylene type bond can also be used. As a group for linking aromatic sulfonic acids, a $—CH_2—$ group is particularly preferable because production is simple and it is easy to get. A compound having a linking group represented by $—(CH_2)_n—T_x(CHR—)_m—$ (wherein T represents a benzene ring or a naphthalene ring, R represents hydrogen, a lower alkyl group or a benzene ring, and n, m, x represent integers of 0 or 1, respectively) can be used as well. These condensation products can be a mixture of two or more kinds of condensation products or a copolymer.

As a concrete example of aromatic sulfonates or a condensation product of the salts, a formaldehyde condensation product of β-naphthalene ammonium sulfonate can be presented. The condensation product is a mixture of compounds ranging from monomer units to condensation products of up to about 200 units. The average molecular weight is about 2,000 to 5,000. It is solid at ordinary temperatures and dissolves very feebly in nonpolar solvents such as benzene, but dissolves in low concentrations in polar organic solvents such as acetone and acetonitrile and dissolves in aqueous solvents easily. The viscosity of a 40% by weight aqueous solution thereof at 20° C. is about several dozen to several hundred centipoise. By changing the condensation degree or the solution concentration of the condensation product an appropriate viscosity can be reached. In this way the condensation products can be made spherical.

As a forming auxiliary agent, various polymer compounds soluble or capable of being dispersed as a colloid in water or an aqueous solution can be used. As the forming auxiliary agent, water-soluble polymer compounds including polyalkylene oxide compounds such as a condensation product of ethylene oxide and propylene oxide, or a condensation product of these and alcohol, aliphatic acid, alkyl amine, and alkyl phenol; polyvinyl compounds such as polyvinyl alcohol and polyvinyl pyrrolidone; and polyacrylic acid compounds such as polyacrylic acid, polyacryl amide, and acrylic acid-acrylic acid copolymer can be used. Further, a surfactant or an antifoaming agent for decreasing the surface tension can be used together for facilitating the formation. A dried and pulverized formaldehyde condensation product of β-naphthalene ammonium sulfonate can be used to adjust the viscosity to an appropriate degree. Aromatic sulfonic acids and polystyrene sulfonic acids, which are one type of condensation product of the salts thereof; of the present invention can be used as a water-soluble polymer as well.

A method for forming fine spherical bodies of aromatic sulfonic acids or a condensation product of a salt thereof is not particularly specified. For example, after dissolving aromatic sulfonic acids or a condensation product of a salt thereof in a solvent, a fine spherical body can be formed by known methods such as the spray dry method and the precipitation method where an antisolvent is added. Among the forming methods, the spray dry method is preferable as a method for forming a fine spherical body with aromatic sulfonic acids or a condensation product of a salt thereof because it is possible to produce spherical particles with small particle size using simple production apparatus. Preferable examples of the solvents used in the methods include water; alcohols such as methanol; and polar solvents such as acetonitrile. In particular, aqueous solvents such as water and a mixture of water and another water-soluble solvent are preferable in terms of safety. If an aromatic group condensation product derived from a material of aromatic sulfonate, which is not sulfonated, exists, the carbonaceous particles obtained become uneven. Since the condensation product is barely soluble in water, the use of an aqueous solvent is also advantageous because impurities can be eliminated easily.

The particles for an electro-rheological fluid of the present invention must be spherical. The term "spherical" used herein denotes that particles observed with an electron microscope are spherical. Preferably, both the deviation of the maximum diameter of a particle and the deviation of the minimum diameter of the particle are within 30% of the average diameter, more preferably within 20%. The bumpiness, of the surface gap, in a theoretical particle with an ideal smooth spherical shape, is preferably 10% or less with respect to the average diameter, and more preferably 5% or less. Most preferably, the deviation of the maximum diameter of a particle and the deviation of the minimum diameter of the particle are within 10% of the average diameter, and the bumpiness, of the ideal spherical surface gap, is 3% or less with respect to the average diameter. The term "the average diameter" of one particle used herein refers to the average value of the maximum diameter and the smallest diameter of the particle.

As carbonaceous particles of the present invention, those having 80 to 97% by weight of the carbon content are preferable, those having 85 to 95% by weight are particularly preferable. The C/H ratio (carbon/hydrogen atom ratio) of the carbonaceous particles is preferably 1.2 to 5, 2 to 4 is particularly preferable.

It has been known for a long time that the electrical resistance of the dispersed phase of an electro-rheological fluid is, in general, in a semiconductor domain (W. M. Winslow: J. Appl. Physics vol. 20, page 1137 (1949)), however, carbonaceous particles having less than 80% by weight of the carbon content and a C/H ratio of less than 1.2 are insulating materials, and thus liquid having an electro-rheological effect can barely be obtained therefrom. On the other hand, those having more than 97% by weight of the carbon content and a C/H ratio of more than 5 are like conductive materials and show an excessively large electric current even when voltage is applied, and thus liquid having an electro-rheological effect cannot be obtained.

As a method of producing spherical carbonaceous particles, a method of carbonizing the above-mentioned aromatic sulfonic acids or a condensation product of a salt thereof formed in a fine spherical body by the heat treatment in an inert gas atmosphere such as nitrogen and argon so as to maintain the spherical shape is common.

The carbonizing treatment conditions depend on the physical properties of the desired particle and the kind of the carbonaceous particles used as the starting material. In general, it is preferable to carry out the carbonizing treatment at temperature of from 450 to 550° C. for 2 to 5 hours in an inert gas atmosphere. The inert gas is not particularly specified, but in general, nitrogen gas and rare gases such as argon, helium, and xenon are used. Among these, nitrogen gas and argon gas are preferable in view of their easy accessibility.

The heat treatment temperature in the carbonizing treatment process must be in the range of 400 to 600° C., particularly preferable is 450 to 550° C. The heat treatment can be conducted twice or more. With a temperature lower than 400° C., sufficient electro-rheological characteristics are hard to obtain due to residual impurities such as S, O, and N in the obtained carbonaceous particles. With a temperature higher than 600° C., the electrical resistance of the treated particles becomes low, and the power consumption increases due to the excessively large electric current necessary. Problems such as heat generation at the time of voltage application also arise. Therefore, neither is preferable.

In the carbonizing treatment of a condensation product of ammonium salt of aromatic sulfonic acids, since sulfurous acid radicals and ammonium radicals are eliminated mainly in the range of 250 to 350° C., in order to prevent strength deterioration caused by rapid elimination of volatile components, it is preferable to raise the temperature to the temperature range of 250 to 350° C. gently, or to set the time for maintaining this temperature range.

Since gases including sulfurous acid gas, steam, lower hydrocarbons, hydrogen sulfide, and hydrogen generated by the heat decomposition at the time of heat treatment of aromatic sulfonic acids or a condensation product of a salt thereof, and ammonium gas generated in the case of an ammonium salt contain impurities, it is preferable to purge them with an inert gas.

The average particle size of the particles can be measured with a particle size measuring device (such as a MICROTRAC SPA/MK-II type produced by Nikkiso Co., Ltd.) as mentioned in examples. The average particle size of the particles for an electro-rheological fluid obtained after the carbonizing treatment is preferably about 0.1 to 20 $\mu$m, and more preferably 0.5 to 15 $\mu$m. If the average particle size is less than 0.1 $\mu$m, the initial viscosity of the electro-rheological fluid obtained becomes high. On the other hand, if the average particle size is more than 20 $\mu$m, the dispersion stability of the particles deteriorates. Neither is preferable.

Furthermore, it is preferable that the carbonaceous particles have a collapsing strength of 5 kgf/mm$^2$ or more, and a maximum displacement amount of 3% or more. These can be measured with a micro-compression tester capable of measuring the strength of each particle (such as MCTM series produced by Shimadzu Corporation) as disclosed in examples. If the collapsing strength is less than 5 kgf/mm$^2$, the strength with respect to particles break-up is insufficient, and when acting as a damper being repeatedly treated to shearing stress, durability lowers. The preferable collapsing strength range is 10 kgf/mm$^2$ more.

The ash content of the carbonaceous particles is preferably 0.1% or less. If the ash content is more than 0.1%, the amount of impurities increases. This leads to loss of electro-rheological characteristics, and thus it is not preferable. The ash content can be measured with an ordinary method.

An electro-rheological fluid can be obtained by dispersing the particles for an electro-rheological fluid of the present invention as mentioned above in an oil type medium. The particles for an electro-rheological fluid, which are dispersoid, are contained in the electro-rheological fluid at a level of 1 to 60% by weight, preferably 20 to 50% by weight, and the oil type medium, which is the dispersion medium, is contained at a level of 99 to 40% by weight, preferably 80 to 50% by weight. If the dispersoid content is less than 1% by weight, the electro-rheological effect is small, and on the other hand, if the content is more than 60% by weight, the initial viscosity when voltage is not being applied becomes high, and thus neither is preferable.

The oil type medium which is a dispersion medium having an electric insulation property, preferably has a volume resistivity at 80° C. of $10^{11}$ Ω·m or more. A value of $10^{13}$ Ω·m or more is particularly preferable. For example, hydrocarbon oil, ester type oil, aromatic type oil, and silicone oil can be presented. Concrete examples include aliphatic monocarboxylic acids such as neocapric acid; aromatic monocarboxylic acids such as benzoic acid; aliphatic dicarboxylic acids such as adipic acid, glutaric acid, sebacic acid, and azelaic acid; aromatic dicarboxylic acids such as phthalic acid, isophthalic acid, and tetrahydrophthalic acid; dimethyl polysiloxane and methyl phenyl polysiloxane. These can be used alone or in combination of two or more.

An oil type medium having an electric insulating property preferably has a viscosity at 25° C. of 0.65 to 500 centistokes, more preferably 2 to 200 centistokes. A value of 5 to 50 centistokes is particularly preferable. By using a dispersion medium having a preferable viscosity, the particles, which are dispersoid, can be dispersed efficiently and stably. If the viscosity of an oil type medium is more than 500 centistokes, the initial viscosity of the electro-rheological fluid becomes high, resulting in a small viscosity change brought about by the electro-rheological effect. On the other hand, if the viscosity is less than 0.65 centistokes, evaporation becomes a problem, and the stability of the dispersion medium deteriorates.

EXAMPLE

Hereinafter the present invention will be explained with reference to concrete examples in more detail. However, it is not limited to these examples.

Property Evaluation:

(1) measurement of particle size:

The particle size of the particles for an electro-rheological fluid were measured with a MICROTRAC SPA/MK-II type device produced by Nikkiso Co., Ltd.

(2) characteristics of the electro-rheological fluid:

The initial viscosity and the viscosity of the electro-rheological fluid with an electric field of 2 kv/mm applied, and the electric current density of the electro-rheological fluid with an electric field of 2 kv/mm applied were measured with an RDS-II type rheometer produced by RHEOMETRICS Far East Co., Ltd., at room temperature (about 25° C.) and at a shear rate of 366/second.

Example 1

Preparation of the Carbonaceous Particle Material:

1050 g of 98% by weight concentration sulfuric acid was added to 1280 g of 95% by weight purity naphthalene, and sulfonated at 160° C. for 2 hours. Unreacted naphthalene and reaction product water were discharged outside the container at reduced pressure. Then 857 g of 35% by weight concentration formalin was added and reacted at 105° C. for 5 hours to obtain a condensation product by a methylene type bond of β-naphthalene sulfonic acid. After neutralization with ammonium water, the condensation product was filtrated with filter paper, no. 5c produced by Toyo Roshi Co., Ltd. to yield a filtrate.

The average molecular weight of the condensation product obtained of a methylene type bond of β-naphthalene sulfonic acid was 4300. Water was added to the filtrate to prepare a 20% by weight concentration aqueous solution of the product of the methylene type bond of β-naphthalene ammonium sulfonate.

The aqueous solution was sprayed with a double fluid nozzle spray drier, type SD-25 produced by Mitsui Mining Co., Ltd., and pulverized with an air pressure of 5 kg/cm$^2$. It was the dried by drying air introduced with an inlet temperature of 180° C. and an outlet temperature of 80° C. The minimum particle size, the maximum particle size, and the average particle size (50% volume average size) of the spherical carbonaceous particles obtained of the methylene bond type condensation product of sulfonic acid mainly comprising methyl naphthalene obtained as mentioned above were 0.1 μm, 12 μm, and 3 μm, respectively.

Preparation of Particles for an Electro-Rheological Fluid:

Spherical particles were obtained by a preliminary heat treatment of the carbonaceous particles obtained at 400° C. in a nitrogen gas atmosphere. The carbon content, the carbon/hydrogen atom ratio (hereinafter referred to as C/H ratio), and the average particle size of the particles were 92.6%, 1.7, and 3 μm, respectively. Spherical particles for an electro-rheological fluid were obtained by further heating (carbonizing treatment) at 500° C. in a nitrogen gas atmosphere. The carbon content, the C/H ratio, and the average particle size of the particles were 94.3%, 2.3, and 3 μm, respectively.

Preparation of an Electro-Rheological Fluid:

35% by weight of the spherical carbonaceous particles obtained in Example 1 was dispersed well in 65% by weight of a silicone oil having a viscosity at 25° C. of 10 centistokes (tsf451-10 produced by Toshiba Silicone Co., Ltd.), which is a dispersion medium, to obtain electro-rheological fluid 1 of the present invention.

The initial viscosity, and the viscosity and the electric current density of the electro-rheological fluid obtained with an electric field of 2 kv/mm applied were measured. Results are shown in Table 1.

Example 2

Under the same conditions as Example 1 except that the heat treatment temperature in the carbonizing treatment process was changed to 490° C., particles for an electro-Theological fluid were obtained. The carbon content, the C/H ratio, and the average particle size of the particles were 94.7%, 2.3, and 3 μm, respectively.

Using the spherical carbonaceous particles obtained in Example 2, electro-rheological fluid 2 of the present invention was obtained in the same process as Example 1, and evaluated as in Example 1. The results are shown in Table 1.

Example 3

Under the same conditions as Example 1 except that the heat treatment temperature in the carbonizing treatment process was changed to 480° C., particles for an electro-rheological fluid were obtained. The carbon content, the C/H ratio, and the average particle size of the particles were 94.8%, 2.2, and 3 μm, respectively.

Using the spherical carbonaceous particles obtained in Example 2, electro-rheological fluid 3 of the present invention was obtained in the same process as Example 1, and evaluated as in Example 1. The results are shown in Table 1.

Example 4

Under the same conditions as Example 1 except that the heat treatment was conducted at a temperature of 520° C. for 4 hours in a rotary kiln, particles for an electro-rheological fluid were obtained. The carbon content, the C/H ratio, and the average particle size of the particles were 93.5%, 2.2, and 3 μm, respectively.

Using the spherical carbonaceous particles obtained in Example 4, electro-rheological fluid 4 of the present invention was obtained in the same process as Example 1, and evaluated as in Example 1. The results are shown in Table 1.

Example 5

Spherical carbonaceous particles obtained as in Example 4 were pulverized and classified with a current jet classifier to obtain particles for an electro-rheological fluid. The carbon content, the C/H ratio, and the average particle size of the particles were 93.5%, 2.2, and 3 μm, respectively.

The collapsing strength and the maximum displacement amount of these particles were measured with a micro-compression tester MCTM-500 produced by Shimadzu Corporation The measurement was conducted for 10 samples and the average value was calculated. As a result, the particles of Example 5 showed a collapsing strength of 21.0 kgf/mm$^2$ and a maximum displacement amount of 40%.

Using the spherical carbonaceous particles obtained in Example 5, electro-rheological fluid 5 of the present invention was obtained in the same process as Example 1, and evaluated as in Example 1. The results are shown in Table 1.

FIG. 1 is an electron microscope photograph of spherical particles for electro-rheological fluid of Example 5 at a magnification of 5000×. The particles are observed to be spherical particles having a smooth surface. That is, the deviations of the maximum diameter and the minimum diameter of the obtained particles with respect to the average diameter were within 10%, and the surface bumpiness thereof was within 3%, respectively.

Example 6

A carbonaceous particle material obtained as in Example 1 was pulverized and classified with a spray drier to obtain carbonaceous particles of 7.0 μm. Adjustment of particles for an electro-rheological fluid:

Spherical particles were obtained by preliminary heat treatment of the obtained carbonaceous particles at 400° C. in a nitrogen gas atmosphere. The carbon content, the C/H ratio, and the average particle size of the particles were 90.8%, 2.0, and 7 μm, respectively. The particles were then given the carbonizing treatment, pulverized and classified to obtain spherical particles for an electro-rheological fluid. The carbon content, the C/H ratio, and the average particle size of the particles were 93.6%, 2.4, and 7 μm, respectively.

The collapsing strength and the maximum displacement amount of the particles were measured as in Example 5. The particles showed a collapsing strength of 23.1 kgf/mm$^2$ and a maximum displacement amount of 33%.

Using the spherical carbonaceous particles obtained in Example 6, electro-rheological fluid 6 of the present invention was obtained in the same process as Example 1, and evaluated as in Example 1. The results are shown in Table 1.

Example 7

An aqueous solution of β-naphthalene ammonium sulfonate obtained in Example 1 was sprayed with a disk atomizer of a spray drier SD-25 type produced by Mitsui Mining Co., Ltd., at 20,000 rpm. It was then pulverized and dried by drying air introduced at an inlet temperature of 160° C. and an outlet temperature of 80° C. The spherical carbonaceous particles of a condensation product by a methylene type bond of β-naphthalene sulfonic acid obtained were classified with an air classifier with the maximum particle size being 20 μm to obtain carbonaceous particles of the minimum particle size, the maximum particle size, and the average particle size (50% volume average size) of 0.5 μm, 22 μm, and 7 μm, respectively. The particles were then given the carbonizing treatment, pulverized and classified as in Example 5 to obtain spherical particles for an electro-rheological fluid.

Using the spherical carbonaceous particles obtained in Example 7, electro-rheological fluid 7 of the present invention was obtained in the same process as Example 1, and evaluated as in Example 1. The results are shown in Table 1.

Example 8

Preparation of the Carbonaceous Particle Material:

1050 g of 98% by weight concentration sulfuric acid was added to 1420 g of absorbing oil (oil mainly comprising methyl naphthalene and dimethyl naphthalene). The absorbing oil was sulfonated at 145° C. for 2 hours. The unreacted oil component and reaction product water were discharged outside the container under reduced pressure. Then 857 g of 35% by weight concentration formalin was added and reacted at 105° C. for 5 hours to obtain a condensation product by a methylene type bond of sulfonic acid mainly comprising methyl naphthalene. Furthermore, the obtained condensation product was filtrated with a glass fiber filter to obtain a filtrate. The average molecular weight of the condensation product obtained was 5000. Water was added to the filtrate to prepare a 15% by weight solid component concentration aqueous solution.

The aqueous solution was sprayed with a double fluid nozzle spray drier SD-25 type produced by Mitsui Mining Co., Ltd., with an air pressure of 5 kg/cm$^2$, pulverized and dried by drying air introduced at an inlet temperature of 180° C. and an outlet temperature of 80° C. The minimum particle size, the maximum particle size, and the average particle size (50% volume average size) of the spherical carbonaceous particles of the methylene bond type condensation product of sulfonic acid mainly comprising methyl naphthalene obtained as mentioned above were 0.1 μm, 12 μm, and 4 μm, respectively.

Preparation of Particles for an Electro-Rheological Fluid:

Particles for an electro-rheological fluid were obtained by the preliminary heating treatment and the carbonizing treatment of the carbonaceous particles obtained as in Example 1. The carbon content, the C/H ratio, and the average particle size of the particles were 92.2%, 2.3, and 4 μm, respectively.

Using the spherical carbonaceous particles obtained in Example 8, an electro-rheological fluid 8 of the present invention was obtained in the same process as Example 1, and evaluated as in Example 1. The results are shown in Table 1.

Comparative Example 1

After a mesophase growing process by heat treatment at 450° C. in a nitrogen gas atmosphere, coal tar pitch was repeatedly extracted, and separated by filtration in tar oil to eliminate the pitch component. After another heat treatment at 350° C. in a nitrogen reflux, it was pulverized to obtain amorphous particles. The carbon content and the C/H ratio of the particles were 90.8% and 2.0, respectively. Particles for an electro-rheological fluid were obtained by conducting a heat treatment at a temperature of 500° C. for 4 hours in a rotary kiln in a nitrogen atmosphere. The carbon content and the C/H ratio the particles were 93.6% and 2.4, respectively.

Using the carbonaceous particles obtained in comparative Example 1, comparative electro-rheological fluid 1 was obtained in the same process as Example 1, and evaluated as in Example 1. The results are shown in Table 1.

Comparative Example 2

After a mesophase growing process by heat treatment at 450° C. in a nitrogen gas atmosphere, coal tar pitch was repeatedly extracted, and separated by filtration in tar oil to eliminate the pitch component. The heat treatment was conducted at 350° C. in a nitrogen reflux again to obtain spherical particles. The carbon content, the C/H ratio, and an average particle size of the particles were 90.8%, 2.0, and 15 μm, respectively. Particles for an electro-rheological fluid were obtained by conducting a heat treatment at a temperature of 500° C. for 4 hours in a rotary kiln in a nitrogen atmosphere. The carbon content, the C/H ratio and the average particle size of the particles were 93.6%, 2.4, and 15 μm, respectively.

Using the carbonaceous particles obtained in comparative Example 2, comparative electro-rheological fluid 2 was obtained in the same process as Example 1, and evaluated as in Example 1. The results are shown in Table 1.

TABLE 1

| | Electro-rheological Effect | | | |
|---|---|---|---|---|
| | Initial viscosity (mPa.sec) | Yield Stress with 2 kV/mm Applied (Pa) | Electric Current Density ($\mu A/cm^2$) | Viscosity Increase after Durability Test |
| Electro-rheological Fluid 1 of the Present Invention | 120 | 355 | 12.0 | None |
| Electro-rheological Fluid 2 of the Present Invention | 120 | 305 | 4.0 | None |
| Electro-rheological Fluid 3 of the present invention | 120 | 290 | 2.0 | None |
| Electro-rheological Fluid 4 of the Present Invention | 85 | 260 | 1.5 | None |
| Electro-rheological Fluid 5 of the Present Invention | 55 | 330 | 3.0 | None |
| Electro-rheological Fluid 6 of the Present Invention | 50 | 250 | 3.0 | None |
| Electro-rheological Fluid 7 of the Present Invention | 50 | 250 | 3.0 | None |
| Electro-rheological Fluid 8 of the Present Invention | 120 | 300 | 4.0 | None |
| Comparative Electro-rheological Fluid 1 | 85 | 120 | 2.5 | Increased (30%) |
| comparative Electro-rheological Fluid 2 | 50 | 200 | 5.0 | Increased (20%) |

As can be seen from the results of Table 1, electro-rheological fluids 1 to 8 of the present invention using particles for an electro-rheological fluid of the present invention provide a sufficient yield stress at the time of applying voltage, higher viscosity at the time of voltage application than the initial viscosity, and a high electro-rheological effect. On the other hand, the electro-rheological fluid of Comparative Example 1 using carbonaceous particles obtained from coal tar pitch as the particles for an electro-rheological fluid had a smaller difference between the initial viscosity and the viscosity at the time of voltage application with respect to Examples, and a sufficient electro-rheological effect was not obtained. Furthermore, electro-rheological fluids 1 to 8 of the present invention improved the electro-rheological effect without a significant increase in the electric current density at the time of voltage application, and thus a high electro-rheological effect was achieved with low power consumption.

Furthermore, an excitation experiment was conducted on the electro-rheological fluids obtained in Examples 1 to 8 and Comparative Examples 1 and 2 with a damper provided with a cylindrical channel at the cylinder outer periphery. The samples were given a 100 mm stroke per second 200,000 times to examine the increase in viscosity of the fluids. Results are shown in Table 1. The electro-rheological fluids of Comparative Examples 1 and 2 showed a viscosity increase of about 20 to 30%. On the other hand, the electro-rheological fluids of Examples 1 to 8 did not show a viscosity increase. Since the particles of the present invention are spherical, they have a large resistance to shearing forces. Besides, as apparent from the results of measuring the crash strength, since they have high anti-break-up strength, they are not prone to particle break-up even when used in a condition having a sliding portion of a high shear rate repeatedly or over a long duration, and thus viscosity increases of the fluids are not observed. Accordingly, an electro-rheological fluid obtained from particles of the present invention has high durability.

What is claimed is that:

1. A method for forming spherical carbonaceous particles, comprising subjecting a condensation product of a methylene type bond of an aromatic sulphonic acid formed of minute spherical particles, or a salt thereof, to a heat treatment in an inert gas environment, wherein the minute spherical particles are formed from a solution of a condensation product of a methylene type bond of an aromatic sulphonic acid or a salt thereof by a spray drying method or a precipitation method.

2. The method for forming spherical carbonaceous particles of claim 1, wherein the heat treatment is carried out at a temperature of 450–550° C. for two to five hours.

3. The method for forming spherical carbonaceous particles of claim 1 wherein the condensation product of a methylene type bond of an aromatic sulphonic acid or the salt thereof is obtained by using an aldehyde to condense the aromatic sulphonic acid or the salt thereof.

4. A method for forming spherical carbonaceous particles, comprising:

forming a condensation product of a methylene type bond of an aromatic sulphonic acid or the salt thereof by using an aldehyde to condense an aromatic sulphonic acid or the salt thereof;

dissolving the condensation product of a methylene type bond of an aromatic sulphonic acid or the salt thereof in a solvent to form a solution;

forming minute spherical particles from the solution by a spray drying method or by a precipitation method; and heat treating the minute spherical particles at a temperature of 450–550° C. for two to five hours in an inert gas environment.

* * * * *